United States Patent [19]

Mannina

[11] 4,210,304

[45] Jul. 1, 1980

[54] TRANSPARENT CEMENT FORM AND METHOD OF FORM USAGE

[76] Inventor: Rosario M. Mannina, 2209 E. Valley Dr., Lindenhurst, Ill. 60046

[21] Appl. No.: 896,698

[22] Filed: Apr. 17, 1978

[51] Int. Cl.[2] ..... E04G 11/02

[52] U.S. Cl. ..... 249/22; 249/27; 249/30; 249/38; 249/189; 249/209; 249/219 R

[58] Field of Search ..... 249/27, 16, 18, 19, 249/22, 30, 38, 47, 207, 209, 219 R, 134, 34, 189, 40

[56] References Cited

U.S. PATENT DOCUMENTS

| | | | |
|---|---|---|---|
| 1,598,131 | 8/1926 | Ham | 249/192 |
| 1,743,136 | 1/1930 | Harrold | 249/33 |
| 1,780,661 | 11/1930 | Wedberg | 249/34 |
| 2,859,503 | 11/1958 | Hennig | 249/189 |
| 2,871,619 | 2/1959 | Walters | 249/134 |
| 3,035,321 | 5/1962 | Hennig | 249/34 |
| 3,357,673 | 12/1967 | Williams | 249/194 |
| 3,503,583 | 3/1970 | Jester et al. | 249/134 |

*Primary Examiner*—Donald J. Arnold

*Attorney, Agent, or Firm*—Laff, Whitesel & Rockman

[57] ABSTRACT

A system for casting cement uses a plurality of light-weight forms made from a ladder-like, aluminum member covered on one side by a sheet of transparent plastic. The forms may be assembled and erected in any desired and suitable shape or configuration. As cement is poured, its surface may be viewed through the transparent plastic to find and correct surface blemishes. A series of connector and optional connection points enables the system to be used in many alternative ways.

27 Claims, 25 Drawing Figures

TRANSPARENT CEMENT FORM AND METHOD OF FORM USAGE

This invention relates to concrete forms and more particularly to prefabricated forms which may be assembled in any convenient configuration to enable cement to be poured in almost any desired shape.

The term "wet building cement" is used herein to mean the construction material used to build buildings, bridges, streets, sidewalks, and the like. This term is not intended to mean any particular kind of building cement, or the like. This term "wet building cement" is intended to distinguish the material used in connection with the invention from the other "cements" such as model airplane glue, heat-responsive material for joining two pices of fabric, plaster of paris, and all other irrelevant cements.

Cement casting is, of course, an old and well-known form of construction. Heretofore, the preformed cement-casting industry has used materials, such as plywood, which may be put together with little or no thought to the final surface appearance of the cast cement. Thus, the final product (e.g., a cast cement wall) often has an embossment of wood grain, a flash of cement between adjacent forms, pockmarks, or the like.

This generally rough appearance of a cast cement wall or other surface is adequate for many different forms of unexposed structures, such as walls which will be covered by bricks or marble, basement walls, utility structures, bridges, or the like. However, it is not acceptable if the wall or other surface is exposed to critical view at image-forming locations, such as a store front, public hallway, or the like. Therefore, it has often been the practice to spend substantial sums for covering, surfacing, or smoothing precast cement. Or, if the surface is to be used directly as cast, special forms have been brought in. This is unfortunate since the modern trends in building are to eliminate "useless" frills and to reduce costs as much as possible.

Also, the weight of cement is such that an extremely strong structure is required to receive and contain poured cement. Therefore, the prefabricated forms have necessarily been very heavy and difficult to carry, install, and remove. This adds to construction costs because it is both tiring and awkward to manipulate the heavy forms.

Of course, there are also many other factors to be considered such as the ease of form assembly and disassembly, the durability of the form, the serviceability of the cast cement structure, and the like. For example, it is common practice to interconnect spaced parallel forms by tie rods, which become embedded in the poured cement and are broken off flush with the cement surface when the forms are removed. The portion of the tie rods which remains embedded in the cement eventually cause passageways for water seepage through the wall. Often, the rust from the bolts discolors the surface of the cement.

Still other considerations will readily occur to those who are skilled in the art.

Accordingly, an object of the invention is to provide new and improved prefabricated forms for assembly into cement-pouring structures.

Another object of the invention is to provide new and improved forms which provide smooth and flaw-free cast cement surfaces. Here, an object is to provide forms which give surfaces which may be inspected and corrected as the wet cement is poured. In this connection, an object is to provide means for correcting surface flaws, as they occur, and before the cement sets and becomes rigid.

Still another object of the invention is to provide an extremely flexible system of very light prefabricated forms, which may be assembled in any desired ones of many different forms and then be disassembled and carried away with equal ease. Here, an object is to provide a system of cement forms which are about one-third the weight of similar prior art forms.

Yet another object of the invention is to provide a system of cement casting forms which do not require many of the auxiliary hardware, structures, or treatments that were required heretofore, such as the rods, oil coating, nails, or the like.

Still another object of the invention is to provide lightweight forms for casting cement which may be set up or taken down quicker than could be done heretofore.

In keeping with an aspect of the invention, these and other objects may be accomplished by forms having aluminum frames and faced with transparent sheet plastic, such as "Plexiglass" or similar material. The inventive form has a pattern of connectors or holes which are distributed over the surface of the form for receiving and mating with suitable fasteners in any of many different positions, to hold together the forms in any of many different configurations dictated by the ultimately desired structure design. The transparent plastic or "Plexiglass" panels enable the wall to be inspected and corrected as it is poured. It is a very smooth surface which gives a finely finished appearance. When used with suitable supporting structures, the forms may be used to make massive and complex cast cement structures.

A preferred embodiment of the inventive system, for accomplishing these and other objects, is shown in the accompanying drawings wherein.

Figure 5:
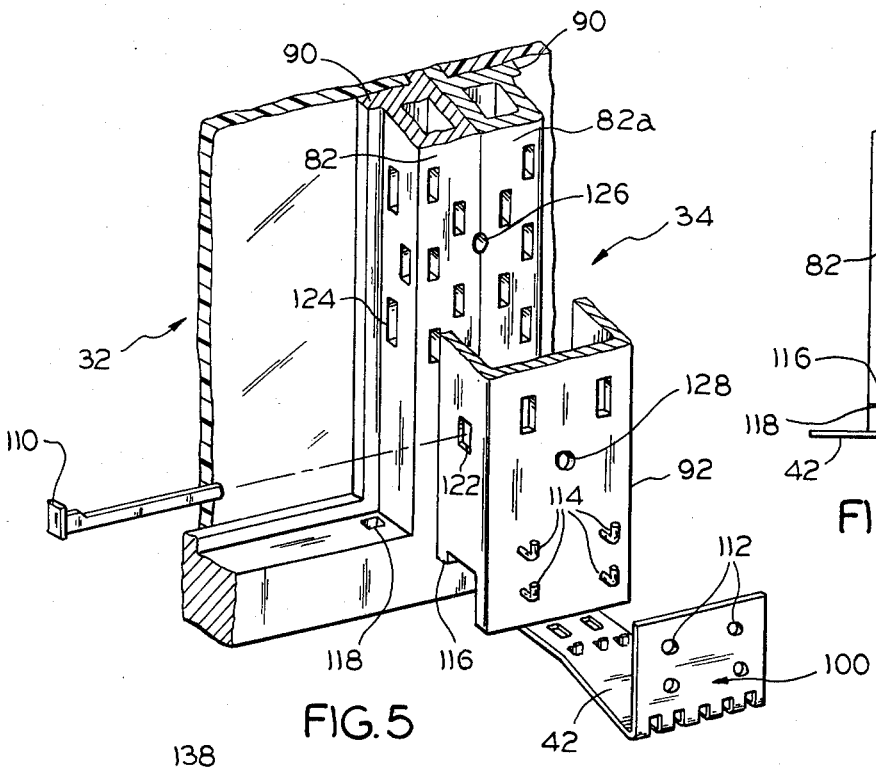
FIG. 5 is a fragmentary and exploded view of two of the edges of panels which are held together by a channel member and of the lower strap form.
Figure 6:
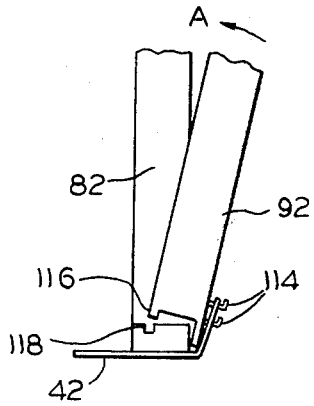
Figure 7:
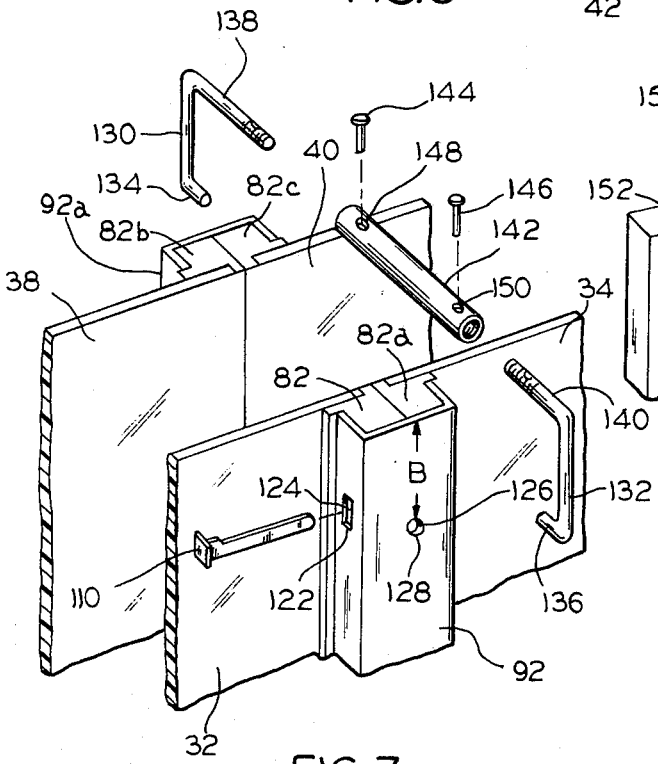
Figure 8:
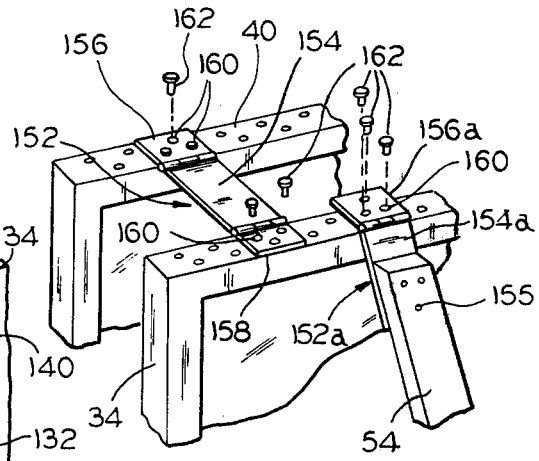
Figure 9:
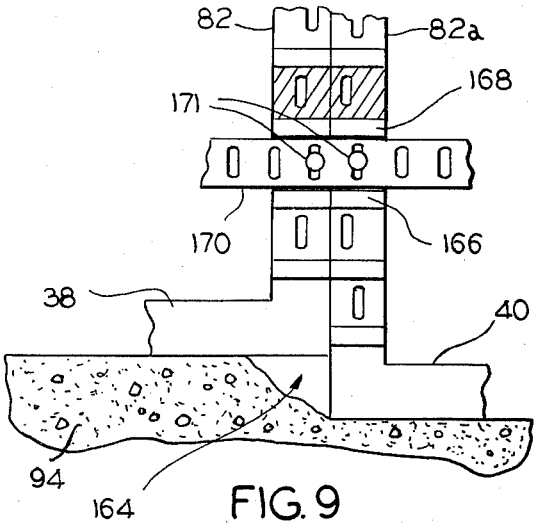
Figure 10:
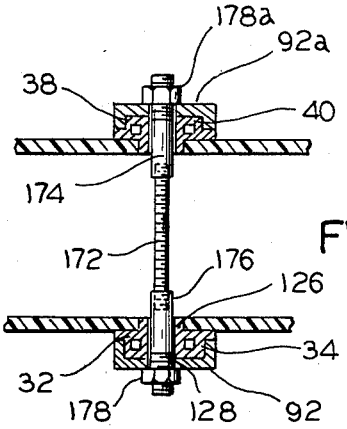
Figure 11:
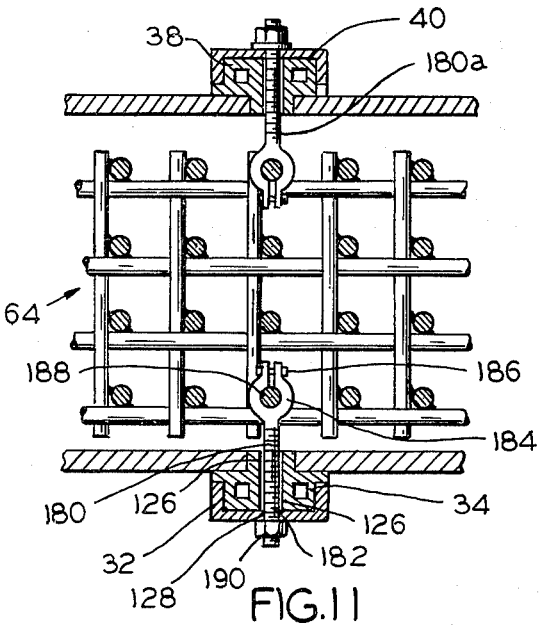
Figure 12A:
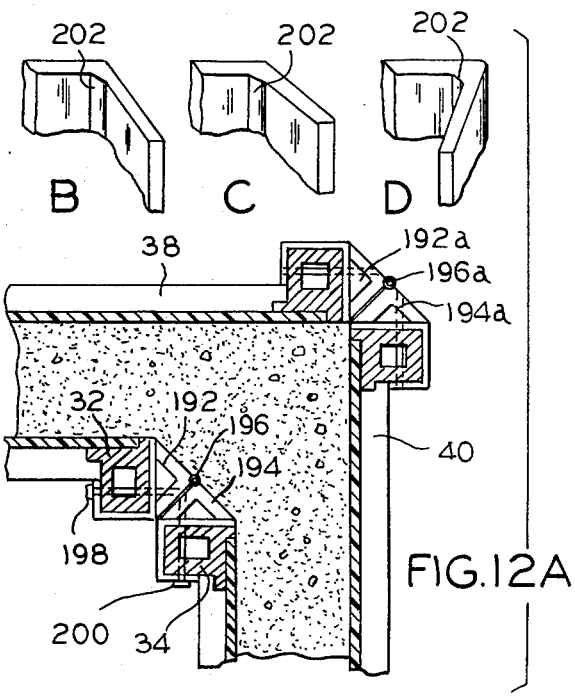

FIG. 6 schematically shows how the channel is attached to the edges of the two frames in FIG. 5;

FIG. 7 is a partially exploded view which illustrates how the tops of the opposing two spaced parallel panels of FIG. 6 are held together;

FIG. 8 illustrates the use of an alternative connector member which may perform a number of different functions such as vertically sway, bracing the form members and holding them in a spaced parallel relationship.;

FIG. 9 is a front elevation view showing another alternative connector by which the forms may be tied together when they are resting on a non-planar base;

FIG. 10 is a fragmentary cross section plan view which shows how spaced parallel forms may be tied together with tie rods which do not extend completely through a finished wall;

FIG. 11 shows how a matrix of reinforcing rods may be fitted into and securely held between a pair of spaced parallel forms;

FIG. 12A is a plan view which shows how pairs of the forms may be hinged together to form a corner;

FIGS. 12B–D schematically illustrate different cast cement forms which may be made with the inventive hinged forms of FIG. 12A.

Figure 13:
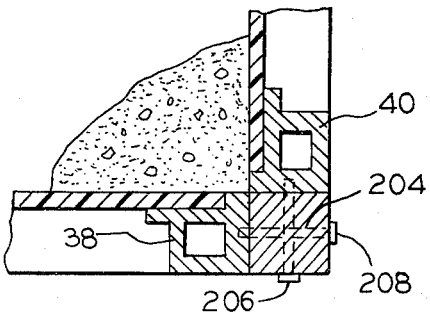
Figure 14:
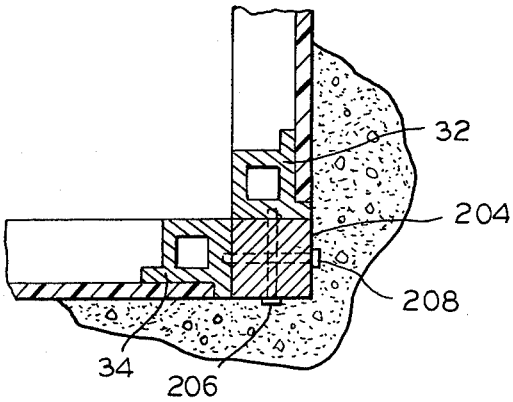
Figure 15:
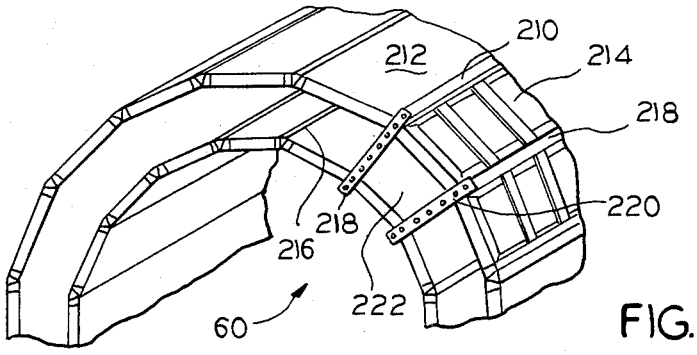
Figure 16:
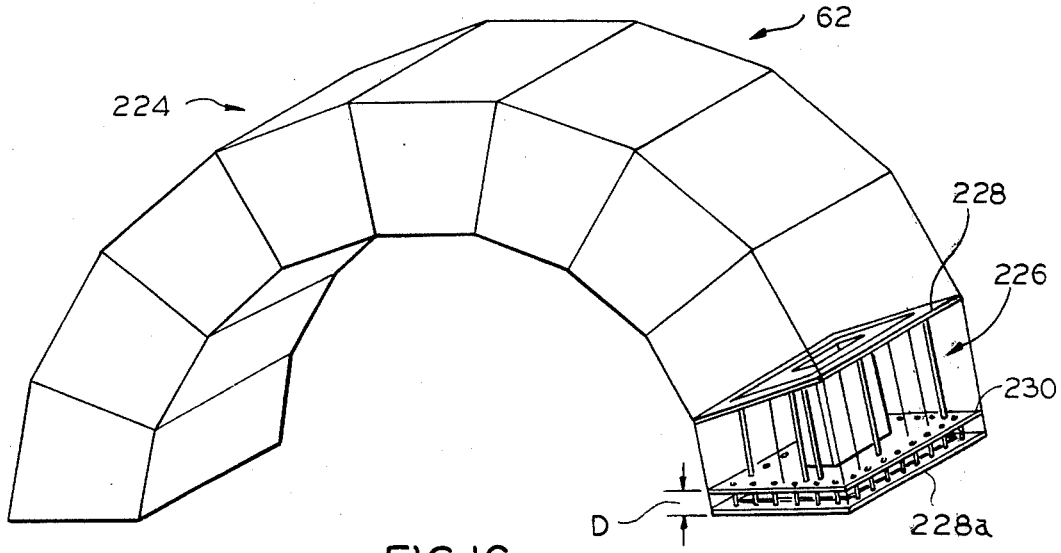
Figure 18:
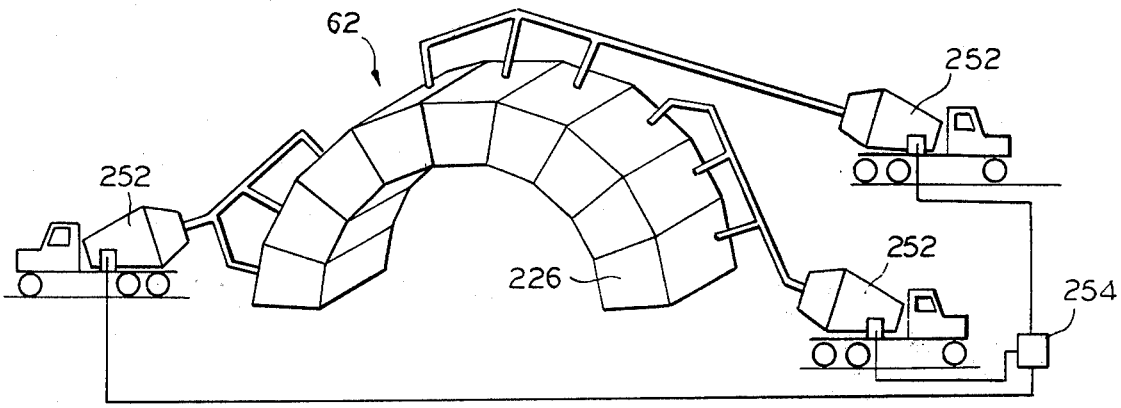
Figure 17:
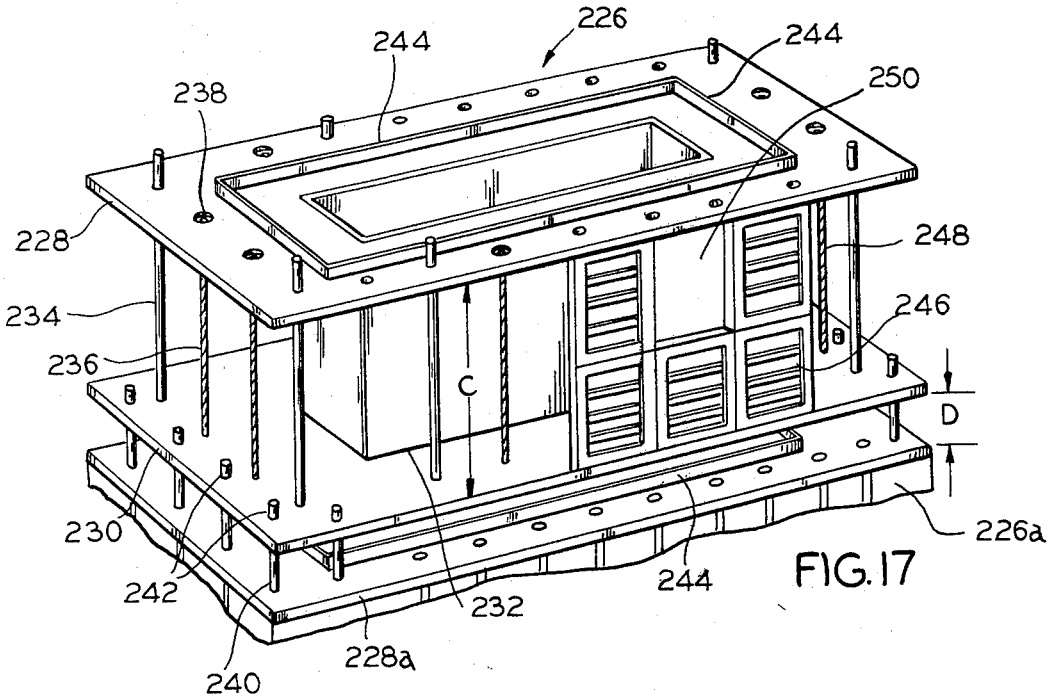
Figure 19:
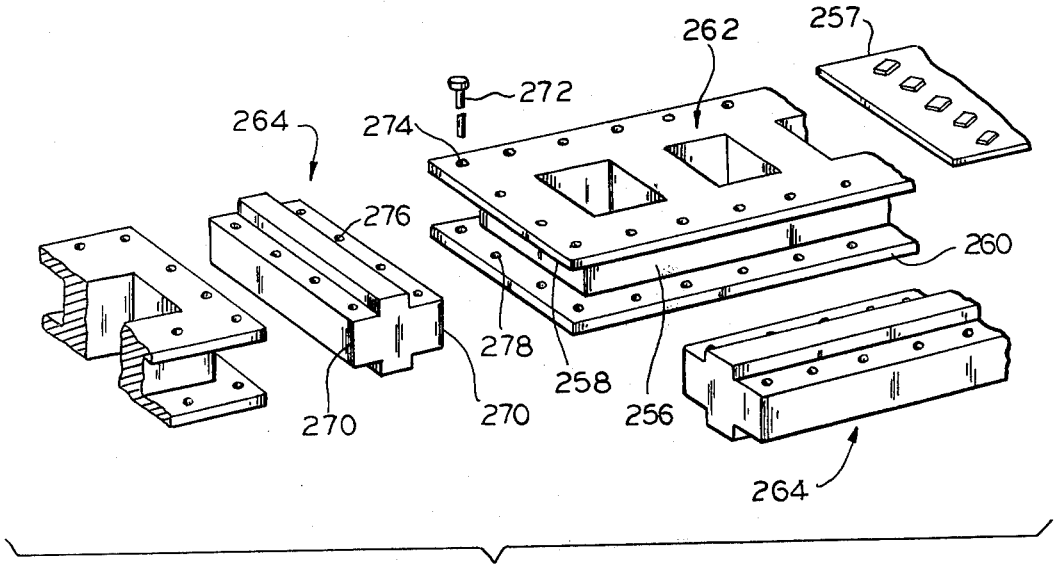
Figure 20:
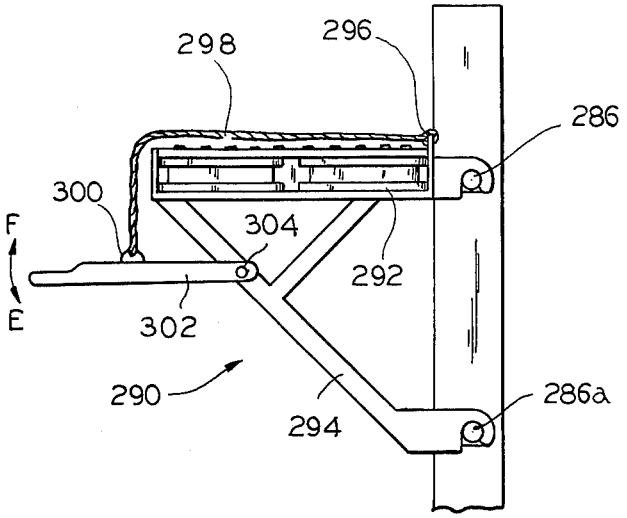
Figure 21:
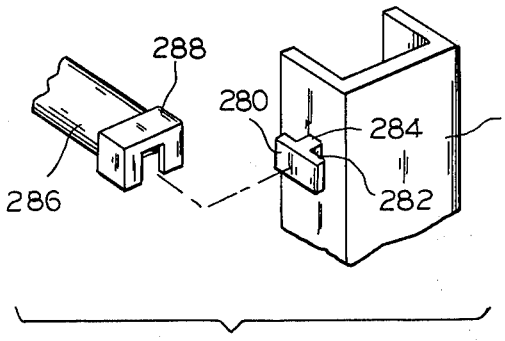
Figure 23:
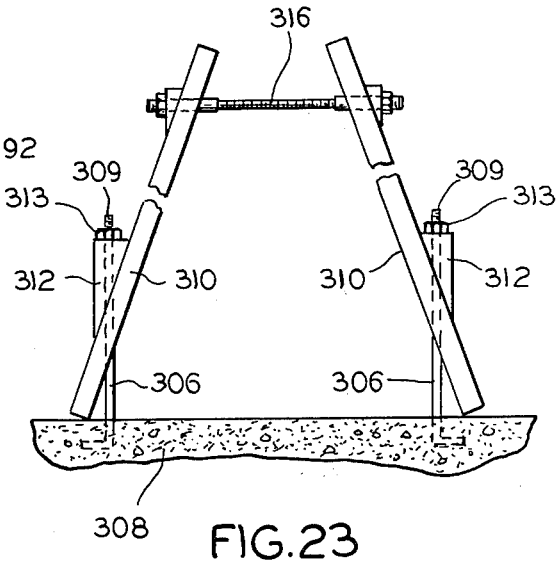
Figure 22:
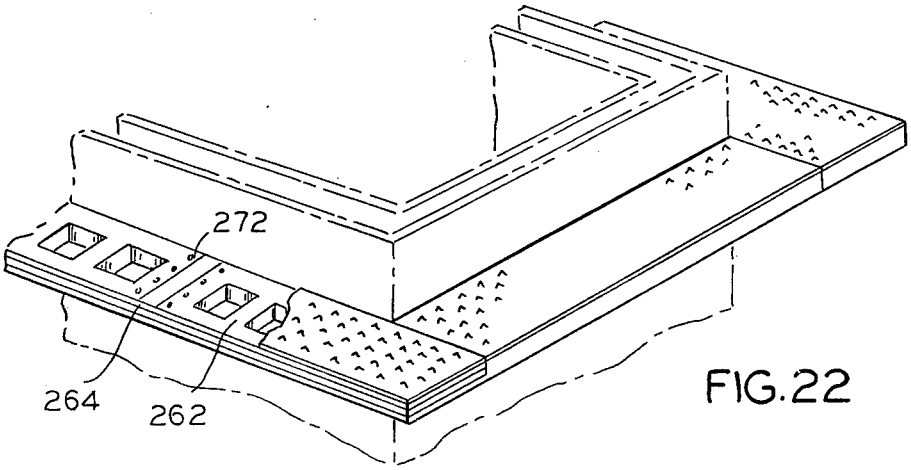

FIG. 13 is a plan view showing another and alternative form for casting outside corners;

FIG. 14 is a similar plan view showing the form of FIG. 13, positioned for casting inside corners;

FIG. 15 is a fragmentary perspective view of a plurality of the inventive forms positioned for casting a relatively small arch;

FIG. 16 is a perspective view which illustrates how the inventive forms may be used for casting a relatively massive arch, such as a highway bridge, for example;

FIG. 17 is a perspective view of a single matrix section taken from the arch of FIG. 16;

FIG. 18 schematically illustrates how cement is pumped into the massive arch forms of FIGS. 16, 17;

FIG. 19 is a perspective view of planking used for constructing a scaffolding which may be hung from the inventive forms;

FIG. 20 is an elevation view which shows how the planking of FIG. 19 may be attached to the inventive forms;

FIG. 21 is a perspective view of a lateral scaffolding support and of an attaching connector therefor;

FIG. 22 is a perspective view of the scaffolding of FIGS. 19, 20, 21 attached to an assembled number of the inventive forms; and FIG. 23 is an elevation view of the inventive forms set at angles in order to cast a tapering cement structure, as at the foot of a load-bearing wall, for example.

A plurality of the inventive forms are shown (FIG. 1) as being joined together in a spaced parallel arrangement to form a cast wall around the perimeter of a building. Cement will be poured between these forms. After a suitable curing period, the forms will be removed, leaving the cement as a free-standing structure. The forms may rest on any suitable and known form of footing (not shown in FIG. 1). The purpose of the structure is irrelevant. For the purposes of this disclosure, it might be a basement, garage, or assembly hall, a wall, roof, archway, or the like.

Figure 1:
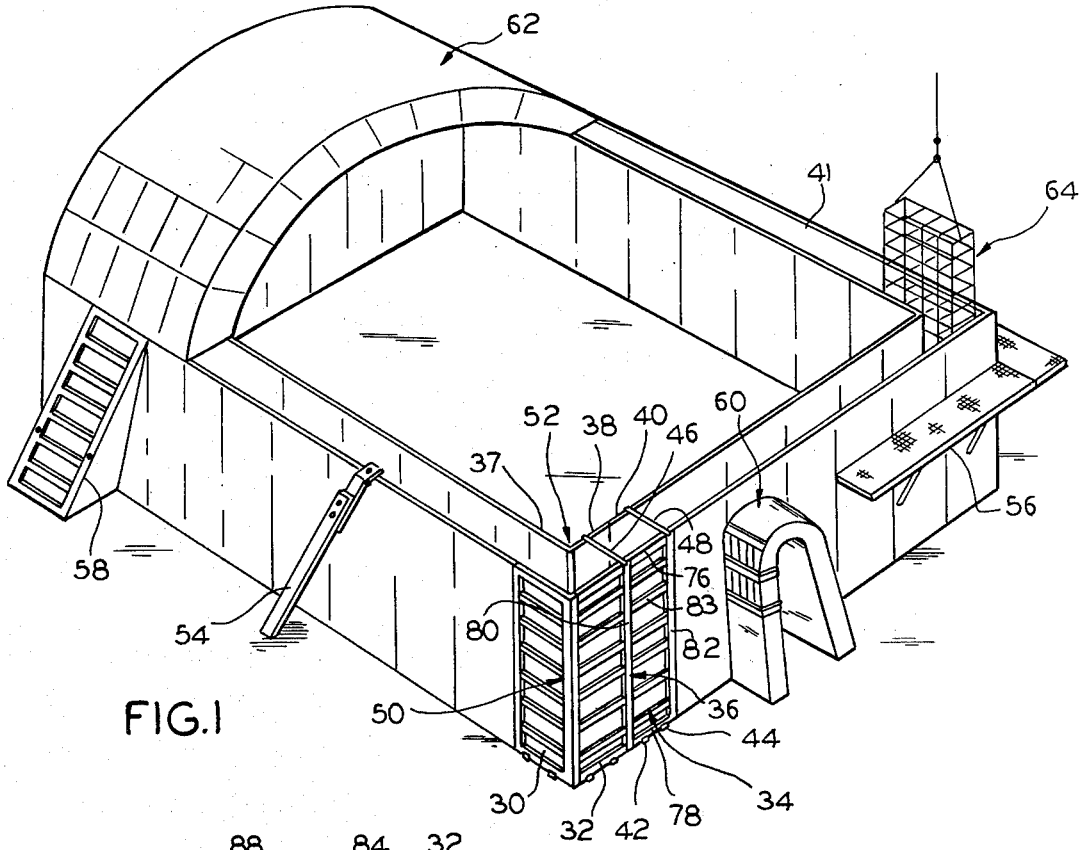
FIG. 1 is a perspective view of the inventive forms set up and prepared to cast an exemplary cement wall.

In greater detail, FIG. 1 illustrates how a plurality of forms 30, 32, 34 may be stood on end and joined together at their side edges, as at 36, for example. These and other forms 30–34 face and oppose each other, in a spaced parallel relationship; for example, forms 30–34 oppose accompanying forms, such as 37,38,40. Together, the opposing, spaced, parallel forms define between them an area 41 for receiving poured concrete. The lower ends of the opposed forms (such as 34,40) are secured in place by bottom brackets or lower straps, as shown at 42,44, for example. The upper ends of the forms are secured by straps or turnbuckles, such as 46,48, which reach over and hook into the tops of the wall forms.

FIG. 1 has been drawn primarily to illustrate a number of different uses of the inventive forms. For example, it is possible to form an outside corner, as at 50, or an inside corner, as at 52. During the assembly of the forms, it may be necessary to attach a 2+4 or similar prop 54 for at least temporarily holding the wall position and stabilizing it against sway. On occasion, it may be necessary to attach a scaffolding 56 to at least some of the forms, to enable workers to stand thereon.

Sometimes, it is necessary to construct a tapered or flared section, as at 58, which may be throught of as a load-bearing column, for example.

Arches may be either small ones (such as 60) which do not require internal bracing or large ones (such as 62) which require massive support and reinforcements. By way of example only, FIG. 1 shows the small arch 60 as being a marquee and the large arch 62 as being part of a roof.

If the cast cement structure becomes sufficiently large, reinforcing rods may be incorporated into the cast cement wall, in any suitable and well-known arrangement. For example, a matrix of rods 64 is here shown as having been welded together in any suitable and desired truss form, and as now being lowered into the space 41, between the forms.

The remainder of the drawings shows details of the system of cement-pouring form which is broadly illustrated in FIG. 1.

Figure 2:
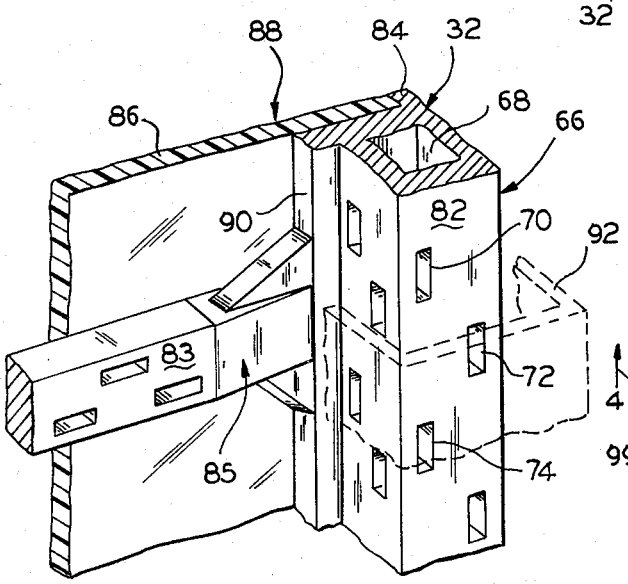
FIG. 2 shows, in perspective, a fragment of the frame to illustrate its construction.

Each of the forms, such as 34, is constructed from a ladder-like frame (preferably made from cast aluminum) and a sheet of transparent plastic material, such as "Plexiglass," for example. FIG. 2 shows a fragmentary cross section of the frame at the intersection of one side rail and one cross rail. Each of these rails is an elongated, generally rectangular beam (such as 66) having a generally hollow core 68 formed therein. A plurality of holes 70,72,74 are formed in the side rail 66, in the area of its surface which enables each hole to communicate into the hollow core 68. This way, a hook or various other fasteners may be hung over the edges or inserted into the holes. This same hollow-cored, perforated structural rail may be used to make the entire frame including the top, bottom, side and interior cross rails 76–83. The corners and intersections of the rails are preferably solid members, as in the area 85 (FIG. 2), for example.

The hole pattern (70,72,74) is repeated along almost the entire length of each rail, uniformly throughout the entire frame structure. Therefore, any side or internal rail of one form may be fitted, at almost any point, against any convenient rail location of any other form, and securely held there by fasteners fitted through the mating holes.

The top, bottom, and two side rails 76,78,80,82 have outstanding lips or edges (as at 84) running entirely around the perimeter of the frame. A sheet 86 of any suitable transparent plastic material (such as "Plexiglass") fits securely into the lip. The dimensions of the lip and the thickness of the "Plexiglass" is such that the entire outer surface 88 is smooth and unbroken. The interior cross rails 83 fit against the inside of the "Plexiglass" sheet 86 to support and stabilize it. A second lip 90 is formed inside the perimeter of the top, bottom and rails to receive and seat a U-shaped channel member 92, that is used to lock the panels together.

Figure 3:
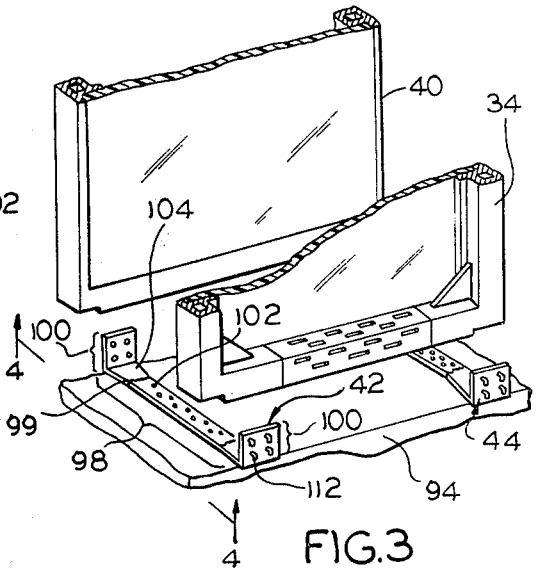
FIG. 3 is a perspective fragment of a cement footing with a pair of bottom brackets or lower straps positioned for securing the lower edges of two opposing forms.
Figure 4:
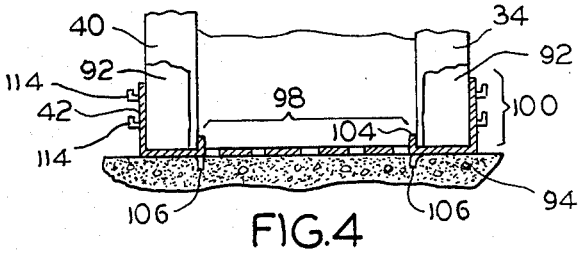
FIG. 4 is a cross section taken along line 4—4 of FIG. 3, with the forms secured in place.

When the panels are to be assembled (FIG. 3), a suitable footing 94 is usually built by casting a cement beam in any known manner. Next, a plurality of bottom brackets 42 or lower edge straps are set upon the footing. Each of these bottom brackets 42 is a generally U-shaped member having a bottom section 98 with a weak area 99 and a length equal to the desired wall thickness plus the thickness of two frame members. The upright ends 100 of the bottom bracket stand tall enough and are wide enough to embrace and securely lock the panels in place. A number of holes 102 are formed in the bottom of the strap to receive and pass the wet cement, when it is poured into the erected forms. The bottom bracket or strap 42 is formed, by semi-piercing detents, to have upstanding bosses 104 for receiving the bottoms of the panels 34,40. The semi-piercing detents also form teeth 106 which depend from the underside of the bottom bracket. These teeth are preferably hardened so that they tend to bite into the footing 94 when pressed downwardly under the weight of the wet cement. After the concrete is poured, the upright portions 100 of these bottom brackets are broken off, along a narrowed or generally weakened area 99 of the bottom strap 98, and the remaining part of the bottom section 98 is abandoned.

It should now be clear that the bottom brackets 42 hold the bottom edges of each of the forms are securely held in a proper relationship, with respect to its opposing form.

As each opposing pair of forms are placed side by side and aligned with each other, the channel 92 is fitted over the two abutting side rails **82,82*a* (FIG. 5), and pinned into place by a number of pins (such as 110). In greater detail, the upstanding part 100 of the bottom bracket 42 (FIG. 5) has four holes 112 formed therein. The bottom of channel 92 has four outstanding L-shaped members 114 formed thereon. These members 114 may be rods having threads on one end, which may be fitted and turned into holes on the bottom of the channel 92. Therefore, as seen in FIG. 6, the L-shaped members 114 may be fitted to hook into holes 112 in the bottom bracket while the channel is held at an angle away from the forms. When the channel 92 is swung in direction A, the holes 112 in bottom bracket 42 are hooked by the hooks 114** and the channel base is thereby locked into position.

The lower inside corner of the channel 92 includes a tab 116 which fits into a hole 118 formed on an inside edge of the lower rail of the inventive form, as the channel is swung into place (i.e., moved in direction A of FIG. 6).

The channel 92 is brought up to snugly embrace and come to rest against the abutting side rails **82,82*a* of the two adjacent forms 32,34 (FIG. 7). In like manner, a corresponding channel 92*a* is brought against corresponding side rails 82*b*, 82*c* on opposing panels 38,40. Suitable pins (such as 110) are inserted through aligned holes 122,124 (FIGS. 5, 7) in channel 92 and abutting side rails 82,82*a*, thereby locking the members securely in place. A plurality of such holes are formed to come into alignment as the channel 92** swings into its locking position.

Half of a bracket-locking hole 126 is formed on each of the abutting side rails **82,82*a*. A plurality of these holes are displaced at fixed or periodical distances along the length of the side rails. The uppermost of these holes 126 and a mating hole 128 on the channel 92 is displaced a distance B, down from the top of the side rails 82,82*a* and the channel 92. Thereafter, they may be repeated periodically at any convenient distance, such as every six to twelve inches. Therefore, two generally U-shaped shackles 130,132 may each have one end 134,136 fitted into the aligned holes 126,128. The other ends 138,140 of the shackles are threaded. A turnbuckle 142 may be placed into alignment with and turned on to the threaded ends 138,140 of shackles 130,132. The turnbuckle is tightened until the forms are securely locked into a desired position. There, two pins 144,146 are inserted through holes 148,150** in the turnbuckle and aligned holes in the shackles.

An alternative topside tie and general purpose bracket 152 is seen in FIG. 8. This bracket includes a central section 154 having a length equal to the desired thickness of the concrete wall. A hinged leaf section 156,158 is pivotally attached to each end of the central section 154. Each hinged section has three holes 160 which align with the universal pattern of holes in the forms. Therefore, the bracket 152 may be placed across the top of the form 34,40, and held in place by pins, such as 162, which may be inserted through the hinged bracket plates 156,158 and into the frame.

The same bracket plate **152*a* may also be used to attach the prop 54 to the top of the form. Here, the central bracket part 154*a* may be attached to the prop 54, in any suitable manner. For example, when the prop 54 is a 2+4, simple wood bolts or screws 155 may complete the attachment. Then the hinged member 156*a*, at the free end of the bracket 152*a* may be attached to the top of the form 34**.

Sometimes, the described brackets cannot be used because the forms are slightly mismatched and the patterns of holes are slightly displaced. For example, in FIG. 9, the drawing shows that footing 94 has a slightly misshapen surface so that the abutting frames 38,40 come together with misalignment at 164.

To accommodate such a misalignment of hole patterns, there is an embossment 166,168 on each side of each hole or set of holes in the form. This also means that there is a depression (one of which is cross-hatched for identification in FIG. 9) on each side of the embossments, such as the depression between embossments 166,168, for example. A tie 170 is in the form of a strap which has an indeterminate length, with a plurality of holes formed periodically therein. The widths of the tie 170 and depressions are approximately equal. Therefore, the ties may be fitted into the depression between adjacent embossments, as the tie 170 is here shown fitted into the depression between the embossments 166,168. Then, it may be pinned into place, as by pins 171, for example. This way, the forms may abut with misalignments which are as close as the width of the space (i.e., the cross-hatched area) between corresponding parts of the embossments on the structure in FIG. 9.

Sometimes it becomes necessary to pour massive cement structure, when it may become impossible to merely depend upon the relatively lightweight structure described thus far. It then becomes necessary to provide a means of some kind for tying together the opposing forms in a more positive manner. For this, the tie rods shown in FIG. 10 may be used. In greater detail, a threaded rod 172 is cut off at a length which is less than the anticipated wall thickness. An internally threaded cylindrical- or pipe-shaped structure 174,176 is threaded onto each end of the threaded rod 172. These pipes fit through the holes 126,128 which may be formed periodically along the length of the side rails 32, 34 and channels **92, 92*a*. A nut 178,178*a*** is tightened on each side of the opposed forms.

After the forms are moved, the pipes 174,176 are rotated so that they unscrew from the ends of the threaded rod 172. This leaves two holes, which may be patched so that the threaded rod 172 is completely buried within the cement and there is no blemish on the surface of the wall. There is no tie rod extending completely through the cement so that water will have no path that may eventually leak or cause rust to discolor the wall surface.

As the cement structure becomes more massive, it may become necessary to embed reinforcing rods in it. If so, these rods are first welded together into a matrix 64 (FIGS. 1 and 11) which is a rigid bundle or truss having desired load-bearing characteristics. A reinforcing tie 180 has threads on one end and a split ring clamp 184 on the other end. When a nut and bolt 186 are removed, the split ring 184 may be forced open and over a reinforcing rod 188 in the matrix 64. Thereafter, the split ring 184 is squeezed together and the nut and bolt 186 are used to clamp together the two halves of the split ring.

The threaded end 182 is fitted through one of the mated holes 126,128 and a nut 190 is tightened thereon, to secure the matrix 64 of reinforcing rods in place between opposing forms. When concrete is poured into the form, it fills in, surrounds and embeds the matrix 64 of rods.

When it becomes necessary to pour a corner (either inside or outside), a hinge deformed from two pivotally-interconnected prisms 192,194 (FIG. 12A) is attached to adjacent forms 32,34. The pivot pin is shown at 196. These prisms 192,194 run along the full length of and is pinned to each of the panels 32,34. Any suitable pins 198,200 are used to attach the hinged prisms 192,194 to the forms.

If the forms are pivoted one way (as shown with forms 32,34), an inside corner is made. However, if the forms are pivoted in a reverse direction (as shown with forms 38,40, an outside corner is deformed). This particular arrangement makes a right angle corner on a cast concrete wall, as shown in FIG. 12B. However, if the forms 32,34,38,34 are swung on their pivots 196 to an obtuse angle, the corner on the cast concrete wall is also an obtuse angle, as shown in FIG. 12C. Or, if the forms are swung on their pivots 196 to an acute angle, the concrete wall also has an acute angle corner, as seen in FIG. 12D.

These pivoted forms are the easiest to use in order to construct a corner; however, they do create a small fillet 202 in the inside corner where the hinge prisms 192,194 are located. Normally, the fillet is not important. However, if the fillet is objectionable, the prismatic hinges 192,194 may be eliminated. In their place, a rectangular corner bar 204 having a length equal to the length of the form is pinned at 206,208 through suitable holes formed in the side rails of the forms. This same corner bar 204 may be used to form either an outside corner (FIG. 13) or an inside corner (FIG. 14).

The invention contemplates forms for casting either small or large arches, as shown at 60,62, respectively in FIG. 1. The forms used for casting small arches is seen in FIG. 15.

For the small arches, the forms are joined by prisms or bars (such as 210) which run the full length of the form. However, these bars differ from the bar 204 in FIGS. 13 and 14. There the bar 204 had a rectangular cross section so that the forms 32,34 or 38,40 are set perpendicular to each other to form a cast cement right angle corner wall. In FIG. 15, the corner bars 210 have a cross section which is not rectangular. Rather, the edges of the corner bar 210 which abut against forms 212,214 (for example) may have a 60 angle, with respect to each other, when three forms are to be used to make an arch. There is a 45 angle, when four forms are to make an arch. These corner bars are pinned in place, by fasteners which pass though the bars and mating holes in the side rails.

The inner side of the arch is formed in a similar manner with the inside corner bars 216 formed at an angle to match the angles of the outside corner bars. However, the average width of each corner bar is somewhat greater in the upper arch forms (i.e., including corner bar 210) than in the lower arch of forms, in order to accommodate the differences in perimeter length between the outside and inside surfaces of the arch.

The two arches of forms in FIG. 15 are tied together by ties 218,220 in order to provide a space 222 for receiving cement that may fill the form. Each of these ties is essentially the same as form 170 described in FIG. 9.

When the arch becomes large enough, as with the roof 62 in FIG. 1, the forms can no longer support the weight of the wet cement. Therefore, as shown in FIG. 16, the large arch 224 must contain steel reinforcing bars and perhaps plate members, also.

Accordingly, a plurality of matrix or cell members 226 are preformed as shown in FIG. 17, for incorporation into the arch of FIG. 16. Each matrix or cell comprises upper and lower, generally parallel, steel plate members 228,230. A preferably rectangular, centrally located, steel tube 232 is welded perpendicularly between the plates 228,230. A distributed number of reinforcing rods (one of which is numbered 234) are also welded perpendicularly between plates 228,230 to form a perimeter of compression elements around the central tube 232. Interspersed between the rods 234 are a plurality of cables (one of which is numbered 236) forming a perimeter of tension elements, also distributed around the central tube. The cables 236 are tensioned by nuts 238 attached to each of their ends and fitted within countersunk holes in the plates 228,230. Thus, each matrix cell contains both tension and compression elements.

Each of the matrix cells 226 rests upon a neighboring cell. For example, the upper plate **228*a* of one matrix cell 226*a* is shown below the lower plate 230 of its neighboring matrix cell 226. A number of guide pins (one of which is numbered 240) are welded or otherwise formed on and integral with each of the top plates 228. A number of guide pin receiving holes (one of which is numbered 242) are formed in each bottom plate. Therefore, then the guide pins are inserted into the corresponding holes, the two plates 228*a*, 230 (and, therefore, the entire matrices 226,226*a*) must be in register with each other. In addition to the guide pins, an upstanding fence 244 is formed on the upper surface of each top plate 228 and a mating debossment (not visible in FIG. 17) is formed on the lower surface of each bottom plate 230. When the two plates rest firmly in contact with each other, the upstanding fence 244 on one plate is captured within the mating debossment in another plate. A plurality of the inventive forms 246,248 are securely attached to each matrix in order to fill the perimeter wall space between the plates 228 and 230**.

Since one embodiment of the forms 228,230 is ten feet long and since the distance C, between the upper and lower plates 228,230 is twenty feet in the same embodiment, two of the forms are placed end to end, as shown at 246,248. The entire perimeter of the matrix cell is so covered with these forms, except for one form location 250, which is left open to receive cement.

A plurality of the matrix cells 226 are formed as separate units. The nuts 238 of the cables are drawn to a predetermined tension, which is less than the desired final tension.

As shown in FIG. 18, after all of the matrix cells 226 have been preformed on the ground, they are hoisted into position in the desired arch configuration. As here shown, there are nine such matrix cells. Each cell is suspended with a space D (FIG. 17) between it and its neighboring cell.

One or more cement trucks 252 are brought in to simultaneously pump wet cement into each of the matrix cells 226 under the control of a central computer 254. Thus, all cells are filled simultaneously and at a rate which causes each of them to settle simultaneously and uniformly so that each lower plate 230 comes to rest upon its neighboring upper plate 228, thereby closing the gap D. This closing of gap D brings the cable 236 tension, and the rod 234 compression to the final desired amount. The confronting plates 228,230 of the neighboring matrix cells 226 come to rest upon each other.

The preferred scaffolding planks (preferably made of aluminum) are shown in FIG. 19 as including a ladder-like member 256 having upper and lower edges 258,260 projecting therefrom, around the entire perimeter thereof. The ladder member 256 provides vertical support to hold the frame in a secure weight-bearing position while the scaffolding is fully loaded. The surface of the ladder member is covered by a diamond plate 257.

Scaffolding plank connector members 264 are made with lengths and thicknesses equal to both the length and the thickness of the ladder members. The cross section of these plank connector members 264 is complementary to the cross-section shape of the planks. Thus, the upper and lower projecting plank edges 258,260 fit into mating notches in the connectors 264. The projecting connector edges 270 come to rest against the corresponding recessed faces of the plank's ladder-like member. Pins, such as 272, are then dropped through mating holes 274,276,278 in the plank 256 and the connector 264. This way, a platform of any suitable size and shape may be constructed.

The scaffolding platform is supported by the brackets of FIGS. 20,21. In greater detail, the inner side of each of the form-connecting channels 92 has a connector 280 welded or otherwise attached thereto at any conveniently selected intervals. Each connector 280 includes an enlarged head 282 and reduced neck dimension-supporting stud 284. A tube 286 has a socket 288 welded to each end thereof. The socket 288 on each end of tube 286 fits over and is captured by a connecter 280 on each of two adjacent channels 92. Thereafter, the tube ends 288 are slipped over opposed connectors and the bar 286 is firmly anchored across the span of a form.

Thereafter, a bracket 290 (FIG. 20) comprising a horizontal portion 292 and a diagonal brace portion 294 is hooked over two of these tubes **286,286*a*, thereby forming a platform-supporting wall brace. Attached to an inner end of the horizontal member 292 is a flexible strap 298, made of any suitable material such as a woven wire mesh, for example. The attachment may be removable, as by means of a hook 296, for example. The other end of the strap 298 is connected to a load binder lever arm 302 which is connected at 304 to the diagonal brace 294. When arm 302 swings in direction E, the strap 298** is tightened over the scaffolding planks and, when it swings in direction F, the strap is loosened.

FIG. 22 is a perspective view of the scaffolding, as it might appear if erected on three sides of an installed system of forms for casting cement.

Sometimes, it is necessary or desirable to cast a tapering or inclined wall. For example, FIG. 1 shows such a tapering or inclined wall member 58 which helps brace and support the large arch 62. This tapering or inclined wall may be cast in the inventive forms, which are set up, as shown in FIG. 23.

In greater detail, a plurality of generally L-shaped rods 306 are set into a cement footing 308, when it is originally poured. At least the upper end 309 of the rod 306 is threaded. When the form 310 is set in place, it is placed over the threaded end 309 of the rod 306 and inclined to the desired angle. A triangular piece of metal 312 is slipped over the free end of the threaded rod 306, to translate the downward thrust of a generally horizontal nut 313 to the slanting surface of the inclined form 310.

If the cement cast inside the inclined form 310 is sufficient mass, it may be desirable to install one or more tie rods, such as 316. The opposing walls 310,310 may be either inclined toward each other or vertical, as may be required. If they are inclined, the same type of L-shaped rods 306 may be employed, as desired.

The method of form usage should now be clear. The inventive form is a lightweight, ladder-like construction having an extremely smooth transparent face thereon. A plurality of these forms may be assembled and secured in place by any one or more of the various hardware items which have been described. If necessary, tie rods, a matrix of reinforcing rods, steel plates, etc. may be installed in the space defined by the frames. Then the cement is poured in a conventional manner.

At those locations where the surface of the cement is subject to view, or for other reasons should be of a smooth and unflawed finish, the surface conditions of the wet cement may be viewed through the transparent plastic or other material. If there are any unsightly blemishes on the surface, they may be corrected before the cement sets up. For example, a vibrator could be temporarily inserted into the wet cement to vibrate it and eliminate air bubbles. Or any other known technique could be used to correct the surface before the cement sets.

Those who are skilled in the art will readily perceive how to modify the system. Therefore, the appended claims are to be construed to cover all equivalent structures which fall within the true scope and spirit of the invention.

I claim:

1. A system for casting wet building cement comprising a plurality of lightweight form means, each of said means comprising a transparent panel having a smooth surface and separate frame means for surrounding said transparent panel for individually supporting and reinforcing around the edges of said panel and across the transparent surface; a plurality of connector means distributed throughout said frame means in order to enable said frames to be interconnected in any of many alternative configurations, said connector means comprises repeated uniform patterns of individual connection points, and means for assembling together a plurality of said frames by interconnecting corresponding frames connecting points on different forms in order to form a double wall enclosure for receiving wet building cement.

2. The system of claim 1 wherein said frame comprises an interconnected plurality of hollow rails and said connector means comprises a plurality of holes in said repeated uniform patterns extending into said hollow rails whereby said frames may be joined by matching holes on adjacent frames and fitting connectors through said matched holes and into the hollow portions of adjacent ones of said rails.

3. The system of claim 1 and means for joining and supporting a plurality of said frames in predetermined non-parallel configurations relative to each other, whereby corners and tapered sections may be formed.

4. The system of claim 3 wherein said joining and supporting means comprise hinge means which enable adjacent frames to be hinged together for pivotal movement to any of an infinite number of angular configurations in order to cast corners in any of an infinite number of corresponding angular configurations.

5. The system of claim 4 wherein said hinge means comprise a pair of prism-like members which extend uninterruptedly over the length of said frame.

6. The system of claim 4 wherein said joining and supporting means comprise a corner post having at least two surfaces set at a predetermined angle with respect to each other for establishing an angle between adjacent ones of said forms, and means including said connector means for interconnecting said corner posts with said surfaces fitting against adjacent ones of said forms whereby said forms are secured to each other at said predetermined angle.

7. The system of claim 6 wherein said corner post has said two surfaces mutually set at right angles, with respect to each other for forming a square corner at the junction of two interconnected forms.

8. The system of claim 6 wherein corner post has said two surfaces mutually set at a non-perpendicular angle which produced an arched configuration of said forms when a plurality of said forms are assembled side by side with said corner posts interconnected between adjacent forms.

9. The system of claim 8 wherein the average widths of said corner posts vary in order to provide arches with different perimeters so that said forms may fit opposite each other in spaced parallel relationships.

10. The system of claim 1 wherein said frame is a ladder-like frame for supporting a sheet of transparent material around its perimeter and at spaced intervals across the width thereof.

11. The system of claim 10 and channel-shaped means for fitting over, embracing and holding together adjacent side rails of said forms, and means comprising said connectors for securing said channel in place when fitted over said adjacent side rails.

12. The system of claim 11 and bracket means for holding pairs of said forms in spaced parallel relationships, and means on an end of each of said channel means for hooking said bracket means and holding a pair of said channels in a spaced parallel relationship in order to anchor said ends of said channel means.

13. The system of claim 12 and means comprising a shackle passing over the opposite ends of said channel means in said spaced relationship, means for tightening said shackle with a turnbuckle for holding the opposite ends of said channels in said spaced parallel relationship.

14. The system of claim 12 and plate means having a pair of hinged leaf sections, each of said leaf sections being pivotally attached to opposite ends of said plate, and means for attaching said hinged leaf sections either to opposing ones of said frames or between one of said frame members and a prop.

15. The system of claim 1 wherein said frame means has periodical means formed therein for receiving a tie strap means in any of a plurality of different positions.

16. The system of claim 1 and tie means comprising a tie rod which does not extend across the entire distance between a spaced parallel pair of said forms, means for gripping the opposite ends of said rod at points intermediate the opposing surfaces of said spaced parallel pair of forms, and means for removing said gripping means after wet building cement is poured into the space between said opposing surfaces, whereby said wall may be patched in the regions where said gripping means were removed in order to prevent said tie rod from forming a passage through said cement wall.

17. The system of claim 1 and means for supporting said frame at an angular position comprising an L-shaped bolt member having one end embedded in a cement footing, the other end of said bolt member fitting through a hole in said frame, a triangular member fitting over said frame member, and means for securing said triangular member in place, whereby the shape of said triangle establishes the angular position of said frame.

18. A system for pouring reinforced wet building cement comprising a plurality of transparent wet building cement receiving forms, each of said forms including a frame supporting transparent sheet material around its edges and across its surface, other and separate assembly means associated with each of said transparent forms for securing said plurality of forms in erected, spaced parallel pairs around the perimeter of a structure; means for preforming a matrix of reinforcing means in a shape and size which fits between said spaced parallel pair of erected forms; and connector means in said matrix for anchoring said matrix in place on connectors on said frames and assembly means, to secure said matrix relative to said erected forms.

19. The system of claim 18 wherein each of said frames comprises a ladder-like frame member having a covering of said transparent sheet material extending thereover, a plurality of holes periodically formed in the side rails of said frame member, each of said holes being a half hole formed in the side rails of said ladder-like frame, whereby an aligned pair of adjacent frames forms a periodic series of completed holes; and said assembly means comprise channel means having a periodic series of holes mating with the holes periodically formed by said aligned frames, and means for fitting said channel means over and securely interconnecting said side rails of the adjacent frames, said periodic holes in said channel being aligned with said holes in said adjacent frames.

20. The system of claim 19 wherein each of said frames has a plurality of holes periodically extending therethrough, each of said anchor means comprising a threaded bolt having a split ring on an end thereof, said threaded bolt fitting through a selected one of said periodic holes and said split ring fitting over and being secured to at least a member of said reinforcing means.

21. The system of claim 19 and a shackle fitting over and interconnecting corresponding holes near the tops of said channels to hold the tops of said frames in a secure position.

22. The system of claim 19 and a plurality of the rods having lengths which are less than the distance between said spaced parallel frames, and connector means fitting through opposed ones of said periodic holes for connecting to and securing the ends of said tie rods while wet building cement is poured into the space between said spaced parallel frames, said connector means being removable after said poured cement hardens, whereby holes in the cement vacated by said connectors may be filled to eliminate holes extending completely through said walls at the locations of said tie rods.

23. The system of claim 18 and reinforcing means in the form of a plurality of matrices, each with opposing plates having tension and compression means extending therebetween, keying means in a surface of said plates which is outside of the area occupied by the tension and compression means for indexing and aligning the plates of adjacent matrices, whereby said adjacent matrices settle upon and interlock with each other responsive to the weight of poured wet building cement, said transparent forms enclosing the perimeter of said plates to provide a cement-receiving enclosure.

24. The system of claim 23 wherein the tension means are cables initially tightened to less than a predetermined tension and the compression means are rods initially compressed to less than a predetermined tension, said settlement responsive to said poured wet building cement bringing said tension and compression to the predetermined levels responsive to the setting of said plates when filled with wet building cement.

25. The system of claim 24 and computer-controlled coordinating means for simultaneously pumping wet building cement into each of said matrices whereby all of said matrices settle upon each other simultaneously.

26. A wet building cement-pouring system comprising a plurality of transparent forms, each form being supported and reinforced around the edges and across the surface by a metal frame having standard interconnecting points so that a plurality of said frames may be assembled in any of many different arrangements whereby said transparent forms may be aligned to provide a smooth surface for casting wet building cement, hardware means for interlocking said frames to provide a double wall perimeter of transparent forms, each perimeter being one of said smooth surfaces for receiving poured wet building cement therebetween, bracket means hung exclusively from said interlocking frames, and scaffolding means supported exclusively by said brackets, said scaffolding means comprising a plurality of lightweight ladder-like forms covered on at least one side by sheet material to form planks, and connector means for securing said planks together to make a platform.

27. The system of claim 26 and strap means attached one end to said brackets and at the other end to lever means pivotally attached to said brackets, said strap fitting over the platform made from said planks and connector, said lever loosening said strap when levered in one direction and tightening said strap when levered in another direction.

* * * * *